United States Patent [19]

Anenson

[11] 4,391,189

[45] Jul. 5, 1983

[54] CODE DATER FOR TRAY FORMING APPARATUS

[75] Inventor: David Anenson, River Falls, Wis.

[73] Assignee: Champion International Corporation, Stamford, Conn.

[21] Appl. No.: 246,150

[22] Filed: Mar. 23, 1981

Related U.S. Application Data

[63] Continuation of Ser. No. 85,788, Oct. 17, 1979, abandoned.

[51] Int. Cl.[3] ..... B41F 17/22

[52] U.S. Cl. ..... 101/36; 101/329; 101/375

[58] Field of Search ..... 493/6, 54, 55, 188; 101/375, 233–235, 35–37, 328, 329

[56] References Cited

U.S. PATENT DOCUMENTS

| | | | |
|---|---|---|---|
| 1,571,664 | 2/1926 | Gilbert | 101/375 |
| 1,880,662 | 10/1932 | Barbieri | 493/55 |
| 2,558,542 | 6/1951 | Davis | 101/213 |
| 2,636,436 | 4/1953 | Mann | 101/36 |
| 2,667,831 | 2/1954 | Streich | 101/233 |
| 2,690,710 | 10/1954 | Aurbach | 101/233 |
| 2,691,936 | 10/1954 | Farkas et al. | 101/35 |
| 2,746,380 | 5/1956 | Gottscho | 101/35 |
| 2,871,781 | 2/1959 | Schrempp | 101/235 |
| 2,975,706 | 3/1961 | Moser et al. | 101/226 |
| 3,144,820 | 8/1964 | Wales | 101/77 |
| 3,162,118 | 12/1964 | Martensson et al. | 101/375 |
| 3,590,700 | 7/1971 | Paxton et al. | 493/6 |
| 3,734,011 | 5/1973 | Williams | 101/235 |
| 4,068,578 | 1/1978 | Delligatti | 101/351 |

*Primary Examiner*—William Pieprz

*Attorney, Agent, or Firm*—Evelyn M. Sommer

[57] ABSTRACT

A code dater for coding tray blanks being formed into trays in a tray forming machine comprising means attached to said machine for maintaining each of said tray blanks in a semi-rigid condition as said blanks move through said machine, and means for printing coded information on said blanks as they are maintained in said semi-rigid condition.

2 Claims, 4 Drawing Figures

CODE DATER FOR TRAY FORMING APPARATUS

This is a continuation of application Ser. No. 85,788, filed Oct. 17, 1979 now abandoned.

BACKGROUND OF THE INVENTION

The present invention relates to the art of printing a code on tray blanks passing through a tray forming machine which folds and glues the blanks to form the desired tray.

Many types of machines are used for accepting stacks of container blanks and properly folding and gluing them to form the various types of containers. The containers may be used for a variety of purposes such as storing and shipping fruit, vegetables and other articles of commerce. The carton or tray forming machines are devised to form containers or cartons or trays of relatively inexpensive materials such as paperboard. It is important in many cases to print a code on the carton which may reflect the date the carton was made, the place or location at which the carton was made and the identity of the individual or group producing the carton or tray.

Such printing has been placed on the carton in the past after the carton or tray has been folded by the tray forming machine. This involves not only extra time, which is expensive, but also requires special equipment because the trays or carton blanks may be of lightweight material which flexes under pressure and thus, must be held rigid while the printing is applied thereto.

SUMMARY OF THE INVENTION

It is therefore an object of the present invention to provide an improved method and apparatus for printing coded information on container or tray blanks as they are being carried through the tray forming machine without the requirement of an extra time consuming step or additional equipment.

The present invention contemplates printing the coded information on said tray blanks as they are maintained in a semi-rigid condition while passing through the tray forming machine.

Thus, the present invention relates to a code dater for coding tray blanks being formed into trays in a tray forming machine comprising means attached to said machine for maintaining each of said tray blanks in a semi-rigid condition as said blanks move through said machine, and means for printing coded information on said blanks as they are maintained in said semi-rigid condition.

The invention also relates to a method of printing coded data on a tray blank being formed into a tray in a tray forming machine comprising the steps of maintaining each of said tray blanks in a semi-rigid condition as it passes at least one stage of said forming machine and printing coded information on each of said blanks while it is maintained in said semi-rigid condition.

BRIEF DESCRIPTION OF THE DRAWINGS

In the drawings, wherein like numerals are employed to represent like parts in the various views, and which forms an integral part of the invention and is to be read in conjunction therewith.

DESCRIPTION OF THE PREFERRED EMBODIMENT

Figure 1:
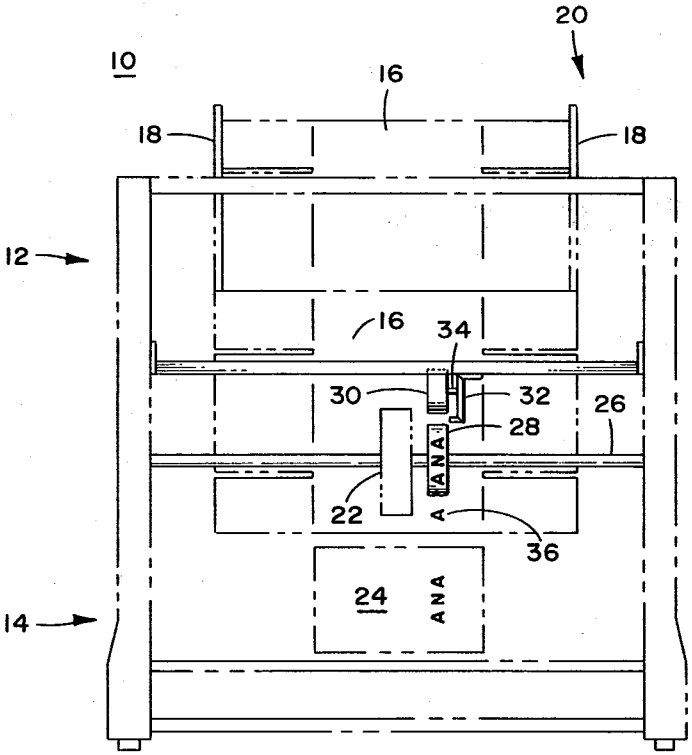
FIG. 1 is a front view of the feeder section and the assembly and compression section of a container forming machine illustrating the downward movement of the tray blanks and the relative locations of the drive wheel, the code dater wheel, and the ink holder.

Referring now to FIG. 1 of the drawings, a front view of a container forming machine 10 is illustrated in phantom outline. Container forming machine 10 includes a feeder portion 12 and an assembly and compression portion 14. The feeding portion 12 of the container forming machine 10 receives tray blanks 16 successively and sequentially from a vertical stack (not shown) and moves them downwardly in a vertical direction sequentially as indicated by arrow 20. Each tray blank is supported by side plates 18 and guided to drive wheel 22 which, in conjunction with an idler wheel 46 shown in FIGS. 2 and 3, causes the tray blank 16 to be transferred to the assembly and compression portion 14. In the assembly and compression portion 14, the tray blank 16 has its sides and ends folded to form a tray, the bottom of which is shown at 24. Such a container forming machine 10 is old and well-known in the art as disclosed in U.S. Pat. No. 3,590,700.

It is important that certain coded information be printed upon each tray blank as it passes through the container forming machine 10. The coded information may represent the date of manufacture, the location of manufacturer, the run number and the like. This information is normally printed upon the completed tray blanks at another location with a separate machine, thus requiring another time consuming step in the process of making the trays and, of course, requires further machines, more labor and obviously greater expense.

The present invention utilizes the existing tray forming machine 10 to perform the code dating with no interruption in the process of forming the trays and with no extra machinery thus saving the time of an extra step in the process and eliminating the expense of a separate machine.

Figure 3:
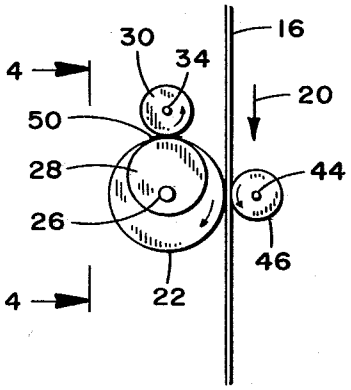
FIG. 3 is a side view of the drive wheel, the idler wheel, the code dater wheel and the ink holder.
Figure 4:
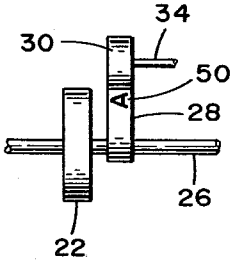
FIG. 4 is an end view of the drive wheel, the code dater wheel and the ink holder taken along the lines 4—4 in FIG. 3.

In FIG. 1, the drive wheel 22 is shown in phantom outline mounted on shaft 26. On the same shaft 26 on which the drive wheel 22 is mounted, a code dater wheel 28 is also mounted. As will be seen in FIGS. 3 and 4, the code dater wheel 28 is mounted eccentrically on shaft 26 in juxtaposed relationship to said tray blank 16 such that as the drive wheel 22 rotates by means of shaft 26, code dater wheel 28 touches the tray blank only once for each revolution of shaft 26. Positioned above code dater 28 is an ink holder 30 which is mounted to a bracket 32 by means of shaft 34. Ink holder 30 may be a wheel having its periphery inked in any well-known manner or may be any other type of inking device well-known in the art such as a spray ink device. The preferred embodiment is a wheel 30 whose periphery is inked by means of a reservoir or in any other well-known manner. As shaft 26 rotates, code dater wheel 28 also rotates and, because it is eccentrically mounted on shaft 26 as shown in FIGS. 3 and 4, the outermost surface thereof, which has the printing thereon, contacts ink holder 30 once each revolution thus applying ink to the code dater wheel 28 prior to the code dater wheel 28 coming in contact with the tray blank 16. The outermost surface of code dater wheel 28 may be an arcuate segment of a circle having the same radius as drive wheel 22 thus allowing as much surface of dater wheel 28 to contact the tray blank 16 as desired. As shown in FIG. 1, the folded tray 24 in the assembly and compression portion 14 of the container forming machine 10 has printed thereon the code letters ANA. Also as shown in FIG. 1, the code dater wheel 28 has already contacted tray blank 16 once and the first portion 36 of the letters ANA can be seen just below the code dater wheel 28. As the tray blank 16 passes along between drive wheel 22 and its idler wheel, the code dater wheel 28 will print a succession of codes across the tray blank.

Figure 2:
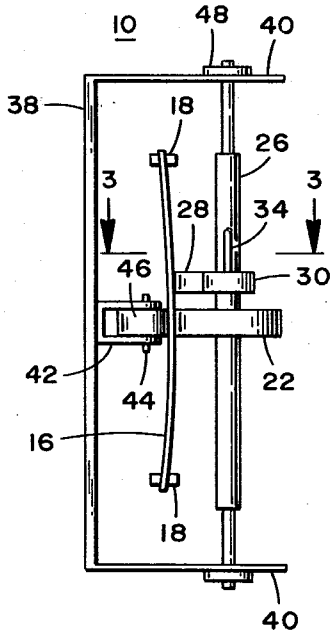
FIG. 2 is a top view of the container forming machine illustrating the path of the tray blank between the drive wheel and the idler wheel and the code dater wheel is abutting relationship with the tray blank thereby printing a code thereon.

FIG. 2 is a top view of the container forming machine 10 which has a frame 38 having side arms 40 thereon. Bracket 42 is attached in any well-known manner to frame 38 and has a shaft 44 therethrough on which an idler wheel 46 is mounted. Between idler wheel 46 and drive wheel 22 is tray blank 16 which is supported at its ends by side plates 18. Drive wheel 22 is turned by shaft 26 in any well-known manner such as by means of a gear 48. Mounted on the same shaft 26 with drive wheel 22 is code dater wheel 28. Code dater wheel 28 is eccentrically mounted on shaft 26 thus extending to the left in FIG. 2 a distance equal to the radius of drive wheel 22. Located immediately above drive shaft 26 is ink holder 30 which, in the preferred embodiment, is a wheel mounted for rotation on shaft 34. In the position shown in FIG. 2, code dater wheel 28 has its printing face in an abutting relationship with tray blank 16 thus printing a code on the surface thereof. When shaft 26 has rotated 180 degrees from the position shown in FIG. 2, the printing face of code dater wheel 28 would be to the right in FIG. 2 and would not make contact with the tray blank 16.

This can be better shown in the side view shown in FIG. 3 which is taken along lines 3—3 in FIG. 2 As can be seen in FIG. 3, tray blank 16 is passing downwardly in the direction of arrow 20 between drive wheel 22 and idler wheel 46. Code dater wheel 28 is shown in FIG. 3 mounted on shaft 26 in an eccentric relationship such that its printing face 50 is at the same radius from shaft 26 as the radius of drive wheel 22. At the location shown in FIG. 3, the print face 50 of code dater wheel 28 is in contact with the surface of ink holder 30 thus having ink applied thereto as the drive wheel 22 is rotating to cause movement of the tray blank 16 downwardly in FIG. 3. When shaft 26 has rotated 90 degrees from the position shown in FIG. 3, the printing face 50 of code dater wheel 28 will be in contact with the surface of tray blank 16 as it passes between the idler wheel 46 and drive wheel 22.

An end view of the relationship of the drive wheel 22, code dater wheel 28 and ink holder 30 is illustrated in FIG. 4 which is an end view taken along lines 4—4 in FIG. 3. It can be seen that the radius of the eccentricity of code dater wheel 28 is equal to the radius of drive wheel 22. Thus as shaft 26 rotates drive wheel 22, it causes the printing face 50 of code dater wheel 28 to turn with drive wheel 22 thus causing printing face 50 to contact ink holder 30 once each revolution and immediately thereafter (90 degrees later) to contact the tray blank which also occurs once each revolution.

The reason that the code dater wheel 28 is located on the same shaft as drive wheel 22 and in close proximity thereto is to take advantage of the semi-rigid condition of tray blank 16 as it passes between drive wheel 22 and idler wheel 46. The tray blank 16 may be formed of any paper stock such as paperboard which is flexible to a degree which depends upon the type of paper stock used. By passing the blank 16 between drive wheel 22 and idler wheel 46 in such a relationship with side support plates 18 as to place a tension on the tray blank by causing it to become slightly arched or bowed, it is maintained in a semi-rigid state.

Because the tray blank is under tension because of its slightly bowed shape, it is in a semi-rigid state which is acceptable for printing thereon. By placing the code dater wheel 28 in a close relationship with drive wheel 22 where the blank 16 is supported between drive wheel 22 and idler wheel 46, the semi-rigid surface is appropriate for printing thereon. Thus, it is important that the printing take place at a stage in the container forming machine 10 wherein the carton for tray blank 16 is maintained in a semi-rigid state or condition.

Thus there has been disclosed a novel and unique code dating apparatus and method by which necessary coded information may be printed on a tray blank as it passes through the container forming machine without the necessity of an added step which takes more time or added machinery which increases the expense of the operation. By allowing the printing to take place where the tray blank is maintained in a semi-rigid condition by the drive wheel and idler wheel, the blank does not flex or move as the printing wheel contacts it thus enabling sharp, clear printing to take place.

While the invention has been described in connection with a preferred embodiment, it is not intended to limit the scope of the invention to the particular form set forth, but on the contrary, it is intended to cover such alternatives, modifactions, and equivalents as may be included within the spirit and scope of the invention as defined by the appended claims.

What is claimed is:

1. A code dater for coding tray blanks being formed into trays in a tray forming machine comprising:

(a) means attached to said machine for maintaining each of said tray blanks in a semi-rigid condition as said blanks move through said machine, said means including a drive wheel mounted on a driven shaft, said drive wheel being rotated in one direction only, said drive wheel being disposed in contact with one side of said blanks thereby aiding in drawing said blanks through said tray forming machine, said means further including a freely rotatable idler wheel disposed on the opposite side of said tray blanks and aligned with said drive wheel, said means further including a pair of side plates for supporting the opposed ends of said tray blanks as they pass through said machine, said drive and idler wheels cooperating with said plates to deform said tray blank into a bow-like configuration to maintain said tray blanks in a semi-rigid condition, said drive and idler wheels being in contact with said blanks at approximately the apex of said bow-like configuration; and (b) means for printing coded information on said blanks as they are maintained in said semi-rigid condition, said means including a circular code dater wheel having a printing font located on the periphery thereof, said wheel being eccentrically mounted at a point spaced from its center on said driven shaft, such that the portion of the periphery of said code dater wheel having said printing font thereon comes into contact with one side of said blanks one time for each revolution of said driven shaft, and with said code dater wheel being mounted in close proximity to and adjacent, said drive wheel, whereby said printing font thereon contacts with tray blanks at a point on said blanks which is maintained in said semi-rigid condition by said drive and idler wheels, in close proximity to and adjacent the apex of said bow-like configuration, and said machine being devoid of any support means for said coder dater wheel on said opposite side of said tray blanks whereby the semi-rigid condition and bow-like configuration of said blanks comprising the sole support surface for said code dater wheel.

2. A code dater as recited in claim 1 further including an inking wheel, said inking wheel located adjacent said code dater wheel, whereby the portion of the periphery of said code dater wheel having said printing font thereon comes into contact with said inking wheel for each revolution of said driven shaft.

* * * * *